US011208609B2

(12) United States Patent
Schlarb et al.

(10) Patent No.: US 11,208,609 B2
(45) Date of Patent: Dec. 28, 2021

(54) LUBRICATING GREASE COMPOSITION

(71) Applicant: DDP SPECIALTY ELECTRONIC MATERIALS US 9, LLC, Midland, MI (US)

(72) Inventors: Tobias Schlarb, Wiesbaden (DE); Christian Kranenberg, Wiesbaden (DE)

(73) Assignee: DDP SPECIALTY ELECTRONIC MATERIALS US 9, LLC, Midland, MI (US)

( * ) Notice: Subject to any disclaimer, the term of this patent is extended or adjusted under 35 U.S.C. 154(b) by 0 days.

(21) Appl. No.: 16/954,267

(22) PCT Filed: Dec. 4, 2018

(86) PCT No.: PCT/US2018/063831

§ 371 (c)(1),
(2) Date: Jun. 16, 2020

(87) PCT Pub. No.: WO2019/125757

PCT Pub. Date: Jun. 27, 2019

(65) Prior Publication Data

US 2021/0087488 A1 Mar. 25, 2021

Related U.S. Application Data

(60) Provisional application No. 62/608,595, filed on Dec. 21, 2017.

(51) Int. Cl.

| | |
|---|---|
| ***C10M 125/24*** | (2006.01) |
| ***C10M 107/00*** | (2006.01) |
| ***C10M 117/02*** | (2006.01) |
| ***C10M 125/10*** | (2006.01) |
| ***C10M 129/68*** | (2006.01) |
| ***C10M 143/06*** | (2006.01) |
| ***C10M 169/02*** | (2006.01) |
| ***C10M 169/04*** | (2006.01) |
| *C10N 10/02* | (2006.01) |
| *C10N 10/04* | (2006.01) |
| *C10N 20/04* | (2006.01) |
| *C10N 40/00* | (2006.01) |
| *C10N 50/10* | (2006.01) |

(52) U.S. Cl.

CPC ..... *C10M 125/24* (2013.01); *C10M 107/00* (2013.01); *C10M 117/02* (2013.01); *C10M 125/10* (2013.01); *C10M 129/68* (2013.01); *C10M 143/06* (2013.01); *C10M 169/02* (2013.01); *C10M 169/04* (2013.01); *C10M 2201/006* (2013.01); *C10M 2201/085* (2013.01); *C10M 2201/0806* (2013.01); *C10M 2201/105* (2013.01); *C10M 2201/14* (2013.01); *C10M 2205/026* (2013.01); *C10M 2207/28* (2013.01); *C10M 2223/02* (2013.01); *C10N 2010/02* (2013.01); *C10N 2010/04* (2013.01); *C10N 2020/04* (2013.01); *C10N 2040/00* (2013.01); *C10N 2050/10* (2013.01)

(58) Field of Classification Search

CPC ..... C10M 169/06; C10M 2201/062; C10M 2201/081; C10M 2201/085; C10M 2201/1026; C10M 2201/105; C10M 2201/1056; C10M 2203/0206; C10M 2209/084; C10M 2209/1033; C10M 2215/1026; C10M 2229/0415; C10M 2229/0425; C10N 2010/04; C10N 2010/08; C10N 2010/02

See application file for complete search history.

(56) References Cited

U.S. PATENT DOCUMENTS

| | | | | |
|---|---|---|---|---|
| 4,525,286 | A * | 6/1985 | Reick | C10M 177/00 508/138 |
| 5,000,862 | A | 3/1991 | Waynick | |
| 5,102,565 | A | 4/1992 | Waynick | |
| 6,420,035 | B1 | 7/2002 | Amano et al. | |
| 2004/0127616 | A1 | 7/2004 | Wentworth et al. | |
| 2008/0011776 | A1 | 1/2008 | Patel et al. | |
| 2009/0221457 | A1* | 9/2009 | Ikezawa | C10M 169/06 508/162 |
| 2010/0264649 | A1 | 10/2010 | Goto et al. | |

FOREIGN PATENT DOCUMENTS

| | | | |
|---|---|---|---|
| CN | 102433195 | A | 5/2012 |
| EP | 1 045 020 | A1 | 10/2000 |
| JP | 2012224834 | A | 11/2012 |

OTHER PUBLICATIONS

International Search Report of the International Searching Authority for PCT/US2018/063831 dated Mar. 25, 2019.

China National Intellectual Property Administration: Search Report for 201880079812.6 Application with an Examiner dated Oct. 15, 2021.

* cited by examiner

*Primary Examiner* — Vishal V Vasisth

(74) *Attorney, Agent, or Firm* — Lorenz & Kopf, LLP

(57) ABSTRACT

A lubricating grease composition, and more specifically, to a lubricating grease composition which, when used with an article clamping device, such as a chuck, produces excellent lubricating properties whilst remaining strongly adhered to metal parts in the clamping mechanism of the device and showing enhanced chemical and physical resistance to fluids such as cutting fluids with which they come into contact.

20 Claims, No Drawings

LUBRICATING GREASE COMPOSITION

This application is a 371 of PCT/US2018/063831, filed Dec. 4, 2018 which claims benefit of 62/608,595 filed Dec. 21, 2017.

The present invention relates to a lubricating grease composition, and more specifically, to a lubricating grease composition which, when used with an article clamping device produces excellent lubricating properties whilst remaining strongly adhered to metal parts in the clamping mechanism of the device and showing enhanced chemical and physical resistance to fluids such as cutting fluids with which they come into contact.

Article clamping devices are well known in the art for various applications. They include, for the sake of example chuck devices (both keyed and keyless) which are used to hold tools with radial symmetry in e.g. drills and mills or for clamping rotating workpieces in lathes and the like. Other clamping devices include collet devices which generally are used in situations where a collar around an article to be held is required and exerts a strong clamping force on the object as it is tightened, usually by means of a tapered outer collar. For the sake of this disclosure article clamping devices may also be considered to include fastening devices or mechanisms for attaching grinding discs, saw blades, and the like to drive spindles. These fastening devices may include conventional nuts, torque enhancing nuts, or similar mechanisms.

Many of these devices, such as keyed and keyless chucks and collets, work on a principle of sliding frictional engagement of actuation members to cause engaging members to grip a tool held in the device. Hence, frictional interfaces are operationally unavoidable and as might be expected are a, if not the, major contributor to wear and eventual degradation of the article clamping devices. The art is constantly striving to reduce the effects of friction on such devices so as to extend the functional life thereof. One particular issue which is increasingly becoming a problem is the inability to identify suitable lubrication materials, e.g. greases, which are able to both lubricate clamping devices and provides enhanced chemical and physical resistance to fluids such as cutting fluids which they regularly come into contact with. However, there is also a need to enhance friction control to ensure proper clamping forces. Lubricating grease is conventionally used for sliding parts in the clamping devices described above. Typically general purpose grease using mineral oil as a base oil and one or more alkali metal soaps or alkaline earth metal soaps as a thickening agent is used in such greases.

A lubricating grease composition for an article clamping device needs to produce excellent lubricating properties whilst remaining strongly adhered to metal parts in the clamping mechanism of the device and showing enhanced chemical and physical resistance to fluids such as cutting fluids to which they come into contact. Most of such lubricants are used in metalworking applications and are exposed to water based cutting fluids.

For the avoidance of doubt a cutting fluid is a type of coolant and/or lubricant designed for use in processes, such as the machining and/or stamping of metals. Cutting fluids may be in the form of oils, oil-water emulsions, pastes, gels and may be made from, for example, petroleum distillates, fats, plant oils and/or water. Cutting fluids are used to keep a workpiece at a stable temperature during e.g. machining, can enhance the useful lifetime the tips of cutting tools or the like. However, by their chemical nature they can negatively affect the lubrication of the moving parts of article holding devices not least because they can wash away or chemically interact with greases used.

Resistance to cutting fluid has been mentioned as a required property for products suitable for lubricating article clamping devices as described above. Such cutting fluids have been modified in recent years to fulfil demanding environmental health and safety (EHS) requirements. Current lubricants (greases) have proven to have limited resistance to many of these modified cutting fluid compositions.

A variety of lubricants with various formulations are available in the market for use as "chuck greases." However, most of these products have weaknesses with respect to constant clamping forces and/or resistance against cutting fluids and indeed are deemed to contain hazardous ingredients.

A suitable lubricating grease composition would therefore require to show the following properties:

- High constant (or slightly declining) level of clamping force over several cycles
- Strong adhesion on metallic surfaces and resistance of being centrifuged off.
- Sufficient chemical and physical resistance against all fluids (especially cutting fluids) used in the metalworking application. A hardening or washing-out of the lubricant will lead to insufficient lubrication and shorter re-lubrication intervals.
- The performance of used cutting fluids should not be negatively influenced by the (chuck) lubricant.
- The lubricant should not contain any toxic, environmental toxic or harmful substances.
- The lubricant should have some corrosion protection to suppress corrosion which impacts negatively the lubrication and clamping forces.

Many currently available lubricants used in these kind of applications are not able to provide all of these requirements.

This disclosure provides a lubricating grease composition comprising:

a) From 15 to 65% by weight of one or more solid lubricants powders;

b) From 15 to 84% by weight of or one more base oils;

c) From 0.5 to 20% by weight of one or more adhesion improver;

d) From 0.5 to 15% by weight of one or more waxes; and e) From 0 to 30% by weight of one or more thickeners.

The lubricating grease as described herein is intended to encompass greases which have high levels of solid lubricants and which are sometimes defined within the industry as "pasty" or are described as "pastes" or "grease pastes" which names are sometimes used to emphasize the contribution of the solid contents therein contributing significantly to the consistency of the lubricant composition.

Component a) may be selected from one or more from the group of calcium oxide, zinc oxide, magnesium oxide, calcium hydroxide, zinc hydroxide, magnesium hydroxide, a carbonate such as calcium carbonate, zinc carbonate, magnesium carbonate, calcium fluoride, zinc fluoride, magnesium fluoride, polytetrafluoroethylene (PTFE), titanium dioxide, a phosphorus containing salt such as a phosphoric acid salt, a metaphosphoric acid salt, a diphosphoric acid salt (pyrophosphate), a triphosphoric acid salt (tripolyphosphate), a phosphorous acid salt, a diphosphorous acid salt, or a hypophosphorous acid salt and zinc salts not listed above.

A specific example of a phosphoric acid salt is a metal salt having a counter anion represented by $PO_4^{3-}$. Examples of salts are represented by but not limited to the following formulae: $Na_3PO_4$, $Ca_3(PO_4)_2$, $AlPO_4$, $Zn_3(PO_4)_2$, $FePO_4$, $Fe_3(PO_4)_2$, $Sn_3(PO_4)_2$, $Pb_3(PO_4)_2$, etc. Specific examples of metaphosphoric acid salts are metal salts having counter anion represented by but not limited to $PO^{3-}$, $P_3O_9^{3-}$, $P_4O_{12}^{4-}$ or similar metal salts. Most preferable are $(NaPO_3)_n$, $K_3P_3O_9$, $K_2Na_2(P_4O_{12})$, etc. A specific example of a diphosphoric acid salt (pyrophosphate) is a metal salt having a counter anion represented by but not limited to $P_2O_7^{4-}$. Most preferable are the following pyrophosphates: $Ca_2P_2O_7$, $Pb_2P_2O_7$, $Fe_4(P_2O_7)_3$, $Zn_2P_2O_7$, $Sn_2P_2O_7$, etc. A specific example of a triphosphoric acid salt (tripolyphosphate) is a metal salt having a counter anion represented by but not limited to $P_3O_{10}^{5-}$. Most preferable are the following tripolyphosphates: $Zn_5(P_3O_{10})$, $Na_5P_3O_{10}$, etc. Phosphorous acid salts can be exemplified by a metal salt having a counter anion represented by but not limited to $PHO^{2-}$. Most preferable are phosphorous acid salts of the following formulae: $ZnHPO_3$, $PbHPO_3$, etc. Diphosphorous acid salts (pyrophosphites) can be exemplified by a metal salt having a counter anion represented by but not limited to $P_2H_2O_5^{2-}$. Most preferable is $Na_2P_2H_2O_5$. Hypophosphorous acid salts can be exemplified by a metal salt having a counter anion represented by $PH_2O_2^-$. Most preferable is $NaPH_2O_2$, or the like. However, the possible hypophosphorous acid salt is not limited by these compounds. In order to provide more uniform dispersion in the lubricating grease composition and prolong the effective period of reducing the friction coefficient on the lubricated parts, Preferred solid lubricants are the aforementioned carbonates (e.g. calcium carbonate), phosphates (e.g. tricalcium phosphate) and zinc salts.

If appropriate Component a), the solid lubricant, may be hydrated or treated to be rendered hydrophobic using, for example stearic acid and/or metal salts of fatty acids such as metal salts of monocarboxylic fatty acids or hydroxymonocarboxylic fatty acids, as well as metal salts of fatty acids derived from animal oils or from vegetable oil, e.g., a seed oil, which are used in the production of metal soaps. Preferable are metal salts of monocarboxylic fatty acids or hydroxymonocarboxylic fatty acids, especially metal salts of the aforementioned fatty acids having 8 to 22 carbon atoms. The following are specific examples of the above metal salts of monocarboxylic fatty acids: metal salts of a lauric acid, myristic acid, palmitic acid, stearic acid, behenic acid, myristoleic acid, palmitoleic acid, oleic acid, or a linoleic aid. The following are specific examples of metals salts of hydroxymonocarboxylic acids: metal salts of 12-hydroxystearic acid, 14-hydroxystearic acid, 16-hydroxystearic acid, 6-hydroxystearic acid, or 9,10-hydroxystearic acid. The aforementioned metal salts of fatty acids may comprise metal salts of one or more types selected from the fatty acid salts of lithium, zinc, magnesium, sodium, or aluminum. Any suitable mixture of the above may be utilised, for example hydrated tricalcium phosphate and calcium carbonate treated with stearic acid. Component a) may be present in a range of from 15% by weight to 65% by weight of the composition, alternatively 20% to 60% by weight of the composition, alternatively 30% by weight to 60% by weight of the composition.

Component b) is one or more base oils. Examples thereof include one or more base oil(s) classified by the American Petroleum in Groups I, II, III, IV and V. Lubricant base oils include natural lubricating oils, synthetic lubricating oils, and mixtures thereof. Groups I to III include base oils derived from petroleum based oils, while Groups IV and V include synthetic base oils including silicones. The chemical composition of the base oils from Group I, Group II and Group III can vary substantially, for example regarding the proportions of aromatics, paraffinics, and naphthenics. The degree of refining and the source materials used to produce the lubricant base oils generally determine this composition. Lubricant base oils from Group I, Group II and Group III include paraffinic mineral oils, aromatic mineral oils and naphthenic mineral oils.

The materials of Groups I, II and III are divided into groups based on sulphur content and Viscosity Index as follows:

Group I base oils generally have a Viscosity Index of between about 80 to 120 and contain greater than about 0.03% by weight of sulfur and/or less than about 90% by weight of saturated organic components (hereafter referred to as "saturates").

Group II base oils generally have a Viscosity Index of between about 80 to 120, and contain less than or equal to about 0.03% by weight of sulfur and greater than or equal to about 90% by weight of saturates.

Group III oils generally have a Viscosity Index greater than about 120 and contain sulphur in an amount less than or equal to about 0.03% weight and greater than about 90% weight of saturates.

Group IV base oils are composed of polyalphaolefins (PAO) which are hydrogenated oligomers obtained from the oligomerization of alphaolefin monomers. These alphaolefin monomers may have from about 4 to about 30 or from about 4 to about 20 or from about 6 to about 12 carbon atoms, such as hexene, octene or decene. The oligomers may be dimers, trimers, tetramers, pentamers, hexamers of the alphaolefin monomer.

Group V base oils include base oils not included in Groups I-IV such as polyinternal olefins (PIO); polyalkylene glycols (PAG); alkylated aromatics such as alkylated benzenes (e.g., dodecylbenzene, tetradecylbenzene, di-nonylbenzene, and di-(2-ethylhexyl)benzene); polyphenyls (e.g., biphenyls, terphenyl and alkylated polyphenyls); synthetic esters such as esters of dicarboxylic acids (e.g., dibutyl adipate, di(2-ethylhexyl)sebacate, di-n-hexyl fumarate, dioctyl sebacate, diisooctyl azelate, diisodecyl azelate, dioctyl phthalate, didecyl phthalate and dieicosyl sebacate); esters of carboxylic acids, polyol esters (e.g., neopentyl glycol, trimethylolethane, trimethylpropane, pentaerythritol, dipentaerythritol and tripentaerythritol); phosphate esters (e.g., tricresyl phosphate, trioctylphosphate, and diethyl ester of decylphosphonic acid); silicones, silicone based copolymers, polyisobutylene (PIB) and halogenated hydrocarbons.

Other lubricant base oils include those of vegetal and animal origin, such as vegetal fatty acids, rapeseed oil, castor oil and lard oil.

Preferred base oils include, synthetic hydrocarbon oils, polyalphaolefins (PAO), polyalkylene glycols (PAG), paraffin-type mineral oil, a diester, a polyol-ester, or a similar ester-type synthetic oil; a co-oligomer of ethylene and α-olefin, a polybutene, or a similar synthetic hydrocarbon oil; an alkylene diphenyl ether, a polyalkylene ether, or a similar ether-type synthetic oil; a diester and a polyol ester, or a similar ester-type oil; and a polydimethyl silicone, a polymethylphenyl silicone, or a similar silicone oil, including silicone based copolymers. These base oils may be used alone or in mixtures of the above. It is further preferable that kinematic viscosity of the base oil of one or more types is in the range of 5 to 2000 $mm^2/s$·at 40° C. The base oil is present in an amount of 15% to 84% by weight of the composition, alternatively from 20 to 80% by weight of the composition, alternatively from 25% to 75% by weight of the composition by weight of the composition.

Component c) is one or more adhesion Improvers such as a polyisobutylene having a number average molecular weight (Mn) of from 200 to 6000, or other polymers dissolved in oil like Poly(methyl methacrylate) and thermoplastic elastomer block-copolymers from the groups TPE-A, thermoplastic copolyesters (TPE-E), thermoplastic olefins (TPE-O), thermoplastic styrene block copolymers (TPE-S), thermoplastic polyurethanes (TPE-U) and/or elastomeric alloys (TPE-V). Component c) is present in an amount of from 0.5 to 20% by weight of the composition, alternatively from 1 to 15% by weight of the composition.

Component d) comprises one or more waxes provided to adjust friction and increase hydrophobicity, examples include natural waxes such as beeswax, synthetic hydrocarbon waxes and polymer waxes and mixtures thereof. The wax is present in the composition in an amount of from 0.5 to 15% by weight of the composition, alternatively from 0.5 to 10% by weight of the composition, alternatively from 1% to 8% by weight of the composition.

Component e) is a thickener for stabilizing the composition, to help retain the base oil and increase resistance towards liquids such as cutting fluids: these may include metallic single and complex soaps of lithium, aluminium, zinc, magnesium, sodium, barium and calcium as well as non-soap organic (Polymer, Polyurea, PTFE) and inorganic (Silica, Bentonite) materials and mixtures thereof, for example, lithium-12-hydroxystrearate and zinc stearate. Component e) may be present in the composition in a range of from 0 to 30% by weight of the composition, alternatively 1.5 to 15% by weight of the composition, alternatively from 1.5% to 10% by weight of the composition, alternatively from 1.5% by weight to 8% by weight of the composition.

The above includes any combination of the alternative ranges of each component providing together and optionally with the additives mentioned below the total % by weight of the composition is 100% by weight.

When required, the lubricating grease composition as hereinbefore described may include one or more conventionally used additives. Such additives include friction modifiers, anti-wear additives, extreme pressure additives, seal swelling agents, rust and corrosion inhibitors, pour point depressants, anti-oxidants, free-radical scavengers, hydroperoxide decomposers, metal passivators, surface active agents such as detergents, emulsifiers, demulsifiers, defoamants, dispersants, and mixtures thereof.

Further additives include deposit control additives, dyes, film forming additives, tackifiers, antimicrobials, additives for biodegradable lubricants, haze inhibitors, chromophores, and limited slip additives.

Examples of friction modifiers include long-chain fatty acids and their derivatives, molybdenum compounds, aliphatic amines or ethoxylated aliphatic amines, ether amines, alkoxylated ether amines, acylated amines, tertiary amines, aliphatic fatty acid amides, aliphatic carboxylic acids, aliphatic carboxylic esters, polyol esters, aliphatic carboxylic ester-amides, imidazolines, aliphatic phosphonates, aliphatic phosphates, aliphatic thiophosphonates, aliphatic thiophosphates.

Examples of anti-wear additives and extreme pressure additives include organosulfur and organo-phosphorus compounds, such as organic polysulfides among which alkylpolysulfides; phosphates among which trihydrocarbyl phosphate, dibutyl hydrogen phosphate, amine salt of sulfurized dibutyl hydrogen phosphate, dithiophosphates; dithiocarbamates dihydrocarbyl phosphate; sulfurized olefins, such as sulfurized isobutylene, and sulfurized fatty acid esters.

Examples of seal swell agents include esters, adipates, sebacates, azeealates, phthalates, sulfones such as 3-alkoxytetraalkylene sulfone, substituted sulfolanes, aliphatic alcohols of 8 to 13 carbon atoms such as tridecyl alcohol, alkylbenzenes, aromatics, naphthalene depleted aromatic compounds, mineral oils.

Examples of rust and corrosion inhibitors include monocarboxylic acids such as octanoic acid, decanoic acid and dodecanoic acid; polycarboxylic acids such as dimer and trimer acids from tall oil fatty acids, oleic acid, linoleic acid; thiazoles; triazoles such as benzotriazole, decyltriazole, 2-mercapto benzothiazole; thiadiazoles such as 2,5-dimercapto-1,3,4-thiadiazole, 2-mercapto-5-hydrocarbyldithio-1,3,4-thiadiazole; metal dithiophosphates; ether amines; acid phosphates; amines; polyethoxylated compounds such as ethoxylated amines; ethoxylated phenols; ethoxylated alcohols; imidazolines; aminosuccinic acids and esters of aminosuccinic acids.

Examples of pour point depressants include wax-alkylated naphthalenes and phenols, polymethacrylates, styrene-ester copolymers.

Examples of anti-oxidants include phenolic antioxidants such as 2,6-di-tert-butylphenol, tertiary butylated phenols such as 2,6-di-tert-butyl-4-methylphenol, 4,4'-methylenebis (2,6-di-tert-butylphenol), 2,2'-methylenebis(4-methyl6-ter t-butylphenol), 4,4'-thiobis(2-methyl-6-tert-butylphenol); mixed methylene-bridged polyalkyl phenols; aromatic amine antioxidants; sulfurized phenolic antioxidants; organic phosphites; amine derivatives such as p-, p'-dioctyldiphenylamine, N,N'-di-sec-butylphenylenediamine, 4-isopropylaminodiphenylamine, phenyl alpha naphthyl amine, ring-alkylated diphenylamines; bisphenols; cinnamic acid derivatives.

Examples of free-radical scavengers include zinc dialkyl dithiophosphates, hindered phenols, and alkylated arylamines.

Examples of hydroperoxide decomposers include organosulfur compounds and organo-phosphorus compounds.

Examples of metal passivators include poly-functional (polydentate) compounds, such as ethylenediaminetetraacetic acid (EDTA) and salicylaldoxime.

Examples of surface active agents such as detergents, dispersants, emulsifiers, demulsifiers include alkali metal or alkaline earth metal salts of organic acids such as magnesium sulfonate, zinc sulfonate, magnesium phenate, zinc phenate, lithium sulfonate, lithium carboxylate, lithium salicylate, lithium phenate, sulfurized lithium phenate, magnesium sulfonate, magnesium carboxylate, magnesium salicylate, magnesium phenate, sulfurized magnesium phenate, potassium sulfonate, potassium carboxylate, potassium salicylate, potassium phenate, sulfurized potassium phenate; common acids such as alkylbenzenesulfonic acids, alkylphenols, fatty carboxylic acids, polyamine, polyhydric alcohol-derived polyisobutylene derivatives.

Examples of defoamants include polysiloxanes, polyacrylates and styrene ester polymers.

Examples of dispersants include alkenylsuccinimide such as polyisobutylene succinimide, N-substituted polyisobutenyl succinimides such as polyisobutenyl succinimide-polyethylenepolyamine, succinates, succinate esters, alkyl methacrylate-vinyl pyrrolidinone copolymers, alkyl methacrylate-dialkylaminoethyl methacrylate copolymers, alkylmethacrylate-polyethylene glycol methacrylate copolymers, polystearamides, high molecular weight amines, phosphoric acid derivatives such as bis-hydroxypropyl phosphorate.

Some additives may possess multiple properties and may be provided for a variety of effects. For example, graphite and molybdenum disulfide may both be used as friction modifiers and extreme pressure additives or functionalized soaps may be used to thicken but also provide greases with extreme pressure and antiwear performances. This approach is well known by the person skilled in the art and need not be further elaborated herein.

An additive may be used alone or in combination with other additives.

When present in the lubricant composition of the invention, the sole or multiple additive(s) may be used at a level of from 0 to 10 wt %, alternatively 0.1 to 5 wt %, based on the total weight of the lubricating grease composition.

Hence the lubricating grease composition comprises any combination of:

a) From 15 to 65% by weight, alternatively 20% to 60% by weight of the composition, alternatively 30% by weight to 60% by weight of the composition of one or more solid lubricant powders
b) From 15 to 84% by weight, alternatively 20 to 80% by weight of the composition, alternatively from 25% to 75% by weight of the composition, of one or more base oils
c) From 0.5 to 20% by weight of the composition, alternatively from 1 to 15% by weight of the composition, of one or more adhesion improver;
d) From 0.5 to 15% by weight of the composition, alternatively from 0.5 to 10 by weight of the composition, alternatively from 1% to 8% by weight of the composition, of one or more waxes;
e) 0. to 30% by weight of the composition, alternatively from 1.5% to 15% by weight of the composition, alternatively from 1.5% to 10% by weight of the composition, of one or more thickeners; and from 0 to 10% by weight of the composition of lubricating additives and wherein the total % weight of the composition is 100%

The lubricating grease composition as hereinbefore described produces excellent lubricating properties in article clamping devices whilst remaining strongly adhered to metal parts in the clamping mechanism of the device for longer periods of time than commercially available materials for the same purpose. The composition provides enhanced chemical and physical resistance to fluids, such as cutting fluids, to which they come into contact. The composition is able to maintain the friction coefficient of the metal parts within a workable range whilst also retaining the ability to apply adequate clamping forces on an object being clamped or to be clamped. It will be appreciated that the coefficient of friction has to be sufficiently >zero, because if it were zero, clamping forces could not be effectively applied to articles to be clamped or being clamped but equally the clamping forces need to be prevented from being too high as this is likely to cause wear on the clamping parts. As a result article clamping devices lubricated with the composition as hereinbefore described have prolonged endurance times for the lubricated parts before the article clamping device has to be re-lubricated even if they are using under severe conditions.

The lubricating grease as hereinbefore described may be made by any suitable method, for example it can be prepared by mixing components a) to e) in any suitable order and introducing optional additives, if present, at appropriate points in the preparation. In one suitable method the lubricating grease composition may be prepared by adding adhesion promoter c), waxes d) and thickeners e) to the base oil(s) b). Components b) to e) are stirred, and if required heated until said components b) to e) are homogeneously mixed. Component a) the solid lubricant(s) are then added to the composition and mixed until homogeneous. The resulting homogeneous mixture is the allowed to cool to room temperature with continuous stirring. Optional additives, if required, may be added to the composition at any point during the process, for example during this cooling step. The resulting homogeneous grease may, if required, be finished by using 3-roll mills or other suitable finishing devices.

The lubricating grease composition of this invention forms lubricating films on the surfaces of moving parts in article clamping devices such as, for the sake of example, chuck devices (both keyed and keyless) which are used to hold tools with radial symmetry in e.g. drills and mills. Other clamping devices include collet devices which generally are used in situations where a collar around an article to be held and exerts a strong clamping force on the object as it is tightened, usually by means of a tapered outer collar. Other article clamping devices include fastening devices or mechanisms for attaching grinding discs, saw blades, and the like to drive spindles (may include conventional nuts, torque enhancing nuts, or similar mechanisms) and systems for clamping rotating workpieces in lathes and the like.

The lubricating grease as hereinbefore described improve the functional lifetime of the clamping devices before the lubricant has to be replaced, not least because of their resistance to the aforementioned cutting fluids. Indeed it would seem that the lubricating greases as provided herein fulfil the desired following properties:

(i) Maintenance of clamping forces

It was unexpectedly identified that the lubricating grease as herein described was after application to an article clamping device (chuck), able to maintain the clamping forces of the device (chuck) within a predetermined range over extended periods of time and large number of device "fastenings and unfastenings when used with or without cutting fluid, i.e. the clamping forces were sufficient to engage and clamp a large number of articles to enable the article to be engineered or to be used to complete a task and the lubricant grease was not removed by the effect of the cutting fluid to the extent that wear commenced. The device was re-greased after a significantly greater number of fastening and unfastenings of the clamp than previously possible using prior art commercial greases for the same purpose.

(ii) Strong adhesion on metallic surfaces and resistance of being centrifuged off. Given (i) above it will be appreciated that the lubricating grease as described herein is strongly adhered to the lubricated parts of the clamping device and is not easily removed by interaction with, for example, the cutting fluid or due to centrifugal forces if/when a clamped article is rotated, particularly at high speed.

(iii) Sufficient chemical and physical resistance against all fluids (especially water and cutting fluids) used in the metalworking application.

Given (i) and (ii) above it is a direct consequence that it can be seen that the lubricating grease as hereinbefore described must have sufficient chemical and physical resistance to, for example, cutting fluids, otherwise the grease would be removed due to the chemical and physical interaction with the cutting fluid If this were not the case, the clamping device (chuck) would need to be re-lubricated much more regularly. This is supported below from the results of the cutting fluid resistance test based on a modified version of DIN 51807 pt. 1" shown in Table 3 below.

EXAMPLES

The invention will be further described with reference to practical examples and comparative examples. It is understood, however, that the invention is not limited by the aforementioned practical examples.

Compositions of greases as hereinbefore described were prepared in accordance with the formulations in Table 1.

TABLE 1

| Ingredient | Example A | Example B | Example C | Example D |
|---|---|---|---|---|
| Calcium Carbonate | 41.50% | 41.50% | 16.83% | 25.00% |
| Polyisobutylene | 9.00% | 9.00% | 9.9% | 7.50% |
| Tricalcium Phosphate | 9.30% | 9.30% | 3.86% | 5.70% |
| Mineral White Oil | 17.10% | 14.30% | 24.75% | 36.50% |
| Mineral Oil Li-12-Hydroxystearate Grease | 18.00% | 20.70% | 40.60% | 14.50% |
| Beeswax | 1.55% | 1.6% | 1.53% | 2.40% |
| Synthetic Hydrocarbon Wax | 1.55% | 1.6% | 1.53% | 2.40% |
| Zinc Stearate | 1.00% | 1.00% | — | 6.00% |
| Corrosion Inhibitor | 1.00% | 1.00% | 1.00% | — |
| Total | 100% | 100% | 100% | 100% |

It can be seen from the composition content that the lubricant grease as described herein does not contain any toxic, environmental toxic or harmful substances.

The samples were then compared with two commercial products to determine the clamping force drop. A Schunk Rota S plus 2.0 manual lathe chuck was lubricated with the sample/comparative being tested and the static clamping force of the chuck was measured. The clamping mechanism of the chuck was moved by using a screw supplied on the side of the chuck. The screw was fitted to an in-house designed adapter which was programmed to tighten the screw (and consequently the chuck) at a speed of 10 revolutions per minute (rpm or sometimes written as 10 l/min) until a torque of 80 Nm was achieved. Once the 80 Nm torque threshold was reached the screw was maintained at that torque for a period of five seconds and then the tightening step was reversed to loosen the chuck at the same speed (10 rpm) to complete a cycle. This process was repeated 100 times, Results with respect to each lubricating grease used following this process were provided in Table 2 below.

TABLE 2

| Example | Cycle 1 [kN] | Cycle 100 [kN] | Max. [kN] | Min. [kN] | Average [kN] | Clamping Force Drop (%) |
|---|---|---|---|---|---|---|
| A | 108.9 | 105.0 | 110.4 | 105.0 | 106.6 | 3.6 |
| B | 109.8 | 95.4 | 110.4 | 95.1 | 99.7 | 13.1 |
| C | 111.0 | 105.9 | 111.0 | 105.6 | 107.5 | 4.6 |
| D | 114.0 | 113.1 | 114.9 | 112.5 | 113.5 | 0.8 |
| Comp. 1 | 114.6 | 90.3 | 114.6 | 90.3 | 97.3 | 21.2 |
| Comp. 2 | 88.8 | 62.7 | 88.8 | 62.7 | 72.7 | 29.4 |

It will be seen from Table 2 that the examples as hereinbefore described all provide significantly smaller clamping force drop than the currently available commercial products used as comparatives. It would appear that this is because the lubricating greases as hereinbefore described provide a significantly better internal lubrication which is retained in/on the metal parts of the chuck and which results in a longer maintenance of clamping forces compared to the commercially available products and as such enable the user to use the chuck for a longer continuous period before the need to re-lubricate the parts.

The invented composition demonstrates relatively constant clamping forces at a high level compared to reference products.

Physical properties of the greases prepared from the ingredients listed in Table 1 and having the properties indicated in Table 2 have been further assessed in respect of several standard properties of importance for greases and the results are provided in Table 3 below.

Unworked and worked penetration were assessed to determine grease penetration. The optimum grease penetration range for this application is from 265 mm/10 to 340 mm/10 as it has been identified as having the best consistency for the application. This is because the resulting composition is suitable to be used with grease guns whilst also being sufficiently "pasty" to stick on lubricated metal parts. Values outside this range may also be suitable for use as and when appropriate and based on the specific application. The value 60× in the Table indicates that the grease was worked 60 times before measurement. Flow pressure is measured because to determine whether a grease will have sufficient pumpability at temperatures below e.g. −20° C. In this instance a flow pressure of less than 1400 mbar is generally interpreted to mean that there should be an appropriate level of pumpability at such lower temperatures.

Dropping point can be used as an indication of the thermal stability of the lubricating grease composition as described herein. This value needs to be significantly above the working temperature of the clamping device. It is anticipated that clamping devices such as chucks and collets will function up to about 60° C., not least because of the cutting fluid acting as coolant.

Water resistance is an important feature for greases for these applications because the cutting fluids are often water based emulsions. In this application instead of the normal period of three hours used under DIN 51807 pt. 1 it was decided samples were tested for water resistance for a full 24 hours. Cutting fluid resistance was assessed based on DIN 51807 pt. 1 excepting that the tests were undertaken over a 7 day period at room temperature. Three commercially available, water miscible cutting fluids were used in this test. They were used in different concentrations of between 5% and 12% by weight in water but in each case as will be seen below the same results were found.

TABLE 3

| | Ex. A | Ex. B | Ex. C | Ex. D |
|---|---|---|---|---|
| Unworked Penetration, ISO 2137: 2007 (en) (mm/10) | 287 | 267 | 329 | 289 |
| Worked Penetration, ISO 2137 2007 (en) 60× (mm/10) | 307 | 290 | 334 | 327 |
| Density @20° C., DIN 51757: 2011-01 (g/ml) | 1.31 | 1.32 | 1.02 | 1.09 |
| Flow Pressure @ −20° C., DIN 51805-2: 2016-09 (mbar) | 900 | 1075 | 550 | 550 |
| Dropping Point, Energy Institute IP 396/02, 10K/min (° C.) | 174.5 | 202 | 190 | 232 |
| Water Resistance, 24 h/90° C., DIN 51807 pt.1 | 0-90 | 0-90 | 0-90 | 0-90 |
| Cutting fluid resistance, tested for a 7 day period at room temperature with 3 different commercial cutting fluids, on basis of DIN 51807 pt. 1 | 0-25 | 0-25 | 0-25 | 0-25 |
| Corrosion Protection DIN51802, using an EMCOR Test rig after a 1 week period in distilled water | 0 | 0 | 0 | 0-1 |

The results in Table 3 above show that the penetration results are within the accepted range. The flow pressure results can be seen to be below the 1400 mbar value required. The dropping point for all examples can be seen to be significantly above the anticipated approximate working temperature for the clamping devices of about 60° C. The water resistance results show that no change was visually noticeable to the observer after the samples were retaining in water at 90° C. Finally a similar result was determined in the presence of the different cutting fluids after 7 days at room temperature. Hence, there was no significant changes in adhesion and appearance after storage in various commercial cutting fluids at room temperature over 1 week. (cutting fluid resistance test, see examples) Excellent water-resistance (Water Resistance, 24 h/90° C., DIN 51807 pt. 1: 0-90, see examples). Hence, it would appear the lubricating grease compositions as hereinbefore described provide both an appropriate level of clamping forces to clamp articles and Table 3 shows they also have good water and cutting fluid resistance which combination has been a potential issue with current commercially available materials. Corrosion testing was undertaken in accordance with DIN 51802, using an EMCOR Test Rig after a 1 week period in distilled water. Results are Rated between 0 (least corrosion to 5 most corrosion).

What is claimed is:

1. A lubricating grease composition comprising:

a) from 20.69 to 50.8% by weight of one or more solid lubricants powders comprising hydrated tricalcium phosphate and calcium carbonate treated with stearic acid;

b) from 14.3 to 36.5% by weight of or one more base oils comprising mineral oil;

c) from 7.5 to 9.9% by weight of one or more adhesion improver comprising polyisobutylene;

d) from 3 to 4.8% by weight of one or more waxes comprising beeswax and synthetic hydrocarbon wax;

e) from 19 to 40.6% by weight of one or more thickeners comprising lithium-12-hydroxystearate and zinc stearate; and an optional corrosion inhibitor present in an amount of from 0 to 1% by weight.

2. A lubricating grease composition in accordance with claim 1 wherein the adhesion improver (c) further comprises other polymers dissolved in oil chosen from Poly(methyl methacrylate) and thermoplastic elastomer block-copolymers from the groups TPE-A, thermoplastic copolyesters (TPE-E), thermoplastic olefins (TPE-O), thermoplastic styrene block copolymers (TPE-S), thermoplastic polyurethanes (TPE-U) and/or elastomeric alloys (TPE-V).

3. A lubricating grease composition in accordance with claim 1 wherein the wax (d) further comprises one or more natural waxes, synthetic hydrocarbon waxes, polymer waxes, or mixtures thereof.

4. A lubricating grease composition in accordance with claim 1 which additionally comprises up to 10% by weight of one or more additives.

5. A lubricating grease composition in accordance with claim 4 wherein the additives are selected from one or more friction modifiers, anti-wear additives, extreme pressure additives, seal swelling agents, pour point depressants, antioxidants, free-radical scavengers, hydroperoxide decomposers, metal passivators, surface active agents chosen from detergents, emulsifiers, demulsifiers, defoamants, dispersants, deposit control additives, film forming additives, tackifiers, antimicrobials, additives for biodegradable lubricants, haze inhibitors, chromophores, and limited slip additives and mixtures thereof.

6. A lubricating grease composition in accordance with claim 1 further comprising a metallic single or complex soap of lithium, aluminium, zinc, magnesium, sodium, barium and calcium, polyurea, PTFE, silica and/or bentonite, and/or mixtures thereof.

7. An article clamping device lubricating grease in accordance with claim 1.

8. An article clamping device lubricating grease in accordance with claim 7 wherein the device is a keyed chuck device, a keyless chuck, a collet and fastening devices or mechanisms for attaching grinding discs, saw blades, and the like to drive spindles.

9. A method of making a lubricating grease in accordance with claim 1 comprising the steps of:

adding adhesion promoter c), waxes d) and thickeners e) into the base oil(s) b), stirring and optionally heating until homogeneously mixed;

(ii) adding component a) the solid lubricant(s) to the composition of (i) and mixing until homogeneous;

(iii) cooling to room temperature with continuous stirring;

(iv) optionally adding optional additives, during step (iii); and (v) optionally finishing using a suitable finishing device.

10. An article clamping device comprising a lubricating grease composition in accordance with claim 1.

11. An article clamping device in accordance with claim 10 wherein the device is a keyed chuck device, a keyless chuck, a collet and fastening devices or mechanisms for attaching grinding discs, saw blades, and the like to drive spindles.

12. The lubricating grease of claim 1 wherein the one or more solid lubricants powders is present in an amount of 50.8% by weight.

13. The lubricating grease of claim 1 wherein the one or more solid lubricants powders is present in an amount of 20.69% by weight.

14. The lubricating grease of claim 1 wherein the one or more solid lubricants powders is present in an amount of 30.7% by weight.

15. The lubricating grease of claim 1 wherein the mineral oil is present in an amount of 14.3% by weight.

16. The lubricating grease of claim 1 wherein the mineral oil is present in an amount of 17.1% by weight.

17. The lubricating grease of claim 1 wherein the mineral oil is present in an amount of 24.75% by weight.

18. The lubricating grease of claim 1 wherein the mineral oil is present in an amount of 36.5% by weight.

19. The lubricating grease of claim 1 wherein the one or more thickeners is present in an amount of 19 to 21.7% by weight.

20. The lubricating grease of claim 1 wherein the one or more thickeners is present in an amount of 40.6% by weight.

* * * * *